United States Patent [19]

Orosz

[11] Patent Number: 4,719,548

[45] Date of Patent: Jan. 12, 1988

[54] PRISMATIC GLOBE FOR STREET LUMINAIRE

[75] Inventor: Edward G. Orosz, Mayfield Heights, Ohio

[73] Assignee: King Luminaire Co., Inc., Willoughby, Ohio

[21] Appl. No.: 900,836

[22] Filed: Aug. 27, 1986

[51] Int. Cl.[4] ..... F21V 7/00

[52] U.S. Cl. ..... 362/309; 362/334; 362/363

[58] Field of Search ..... 362/268, 309, 327, 331, 362/333, 334, 339, 340, 363

[56] References Cited

U.S. PATENT DOCUMENTS

| | | | |
|---|---|---|---|
| 3,395,273 | 7/1968 | Welty | 362/334 |
| 3,766,375 | 10/1973 | Edman et al. | 362/309 |
| 4,434,455 | 2/1984 | Merritt | 362/363 X |

OTHER PUBLICATIONS

Drawing No. 1901-21 of King Luminaire Co., Inc., dated Oct. 1984.

Spring City Shop Drawing, dated Nov. 10, 1980, illustrating Washington No. 16, Twin Ornate.

Spring City Drawing, No. WB12739 dated May 4, 1984, showing light fixture with wall bracket.

Westinghouse Electric Catalog, Section 60-300, p. 7, dated Dec. 1935.

Photographs Showing Ornamental Novalux Unit, in Columbus, Ohio, dated Aug. 11, 1927.

Illustrations of three early street lamp designs, identified by No. A37870, and dated Jan. 29, 1925.

Photograph showing General Electric Company Novalux Unit 118 Globe 1118, dated Oct. 29, 1925.

Photograph of Form 9, Ornamental Novalux Units, in Indianapolis, Ind., dated Aug. 12, 1925.

*Primary Examiner*—Stephen F. Husar

*Attorney, Agent, or Firm*—Wegner & Bretschneider

[57] ABSTRACT

A generally transparent globe capable of covering a light fixture and having an opening at one end for introduction of at least part of said light fixture, including a light bulb. The globe includes integral light refracting prisms extending over at least a substantial portion of the inner and outer surfaces of the globe. Preferably to increase the efficiency of the globe, a reflector is integrally formed in the interior of the globe and is positioned above the light bulb. The globe can be formed from upper and lower portions that are permanently adhered together.

21 Claims, 12 Drawing Figures

PRISMATIC GLOBE FOR STREET LUMINAIRE

BACKGROUND OF THE INVENTION

This invention relates to the luminaire art and in particular to globes suitable for outdoor luminaires.

The use of transparent or translucent globes to cover or enclose a light fixture used outdoors is well known. Originally such globes were made from glass but recently plastic globes, commonly made from polycarbonate, have come into wide spread use. In recent times, plastic globes have been used in conjunction with light fixtures that have the appearance of old fashioned outdoor fixtures such as street lights. An example of a polycarbonate globe is that manufactured by Hadco, a division of Craftlite, Inc. of Littlestown, Penn. This known globe has a heat reflector mounted in the upper portion thereof above the location for the light bulb. The globe is mounted on a waterproof ballast housing having a removable access lid.

Another example of a known outdoor light fixture that employs a polycarbonate globe is that made by Spring City Electrical Mfg. Co. of Spring City, Penn. Mounted inside this globe is a generally cylindrical glass refractor. A cast aluminum mounting bracket supports this refractor and extends upwardly from the ballast compartment at the bottom of the globe. The use of internal refractors is common in the luminaire art but it suffers from the considerable disadvantage that such refractors do not utilize the light emitted from the bulb in an efficient manner.

A common design for a luminaire used at the top of a post is known as an "Acorn or Type 118" post top luminaire. Up until the present invention, this type of luminaire generally contained I.E.S. type II refractors which put out an I.E.S. type IV medium or long non-cut-off light pattern on the roadway with an average of 15% light utilization on a typical forty foot roadway. Such lighting is considered unacceptable by the latest minimum requirements for roadway lighting. The designation I.E.S. stands for Illuminating Engineers Society. There are five standards set up by this society for patterns for lighting a surface. The type II pattern is considered to be the most desirable for a light fixture located between roadway intersections because it results in the most light being delivered to the lane in which the traffic is moving. On the other hand, at an intersection a type V pattern, which is a circular pattern, is considered to be the most desirable.

A globe constructed in accordance with the present invention can be made to use the available light in a highly efficient manner. In fact, the preferred embodiment of the present invention can use in excess of 80% of the light emitted from the bulb. The globe disclosed herein can be made at a reasonable cost and it can be made to look like an old-fashion globe, if desired.

SUMMARY OF THE INVENTION

According to one aspect of the present invention, a globe for a lighting fixture comprises transparent globe means capable of covering a light fixture and having an opening at one end for introduction of at least part of the light fixture. The globe means includes integral prismatic light refracting means extending over at least a substantial portion of the inner and outer surfaces of the globe means.

The globe includes a circular reflector integrally formed in the interior of the globe and adapted to be positioned above a light bulb in the light fixture. The reflector has an opening in the centre thereof positioned above a light bulb in the fixture. The globe is formed from upper and lower portions that are adhered together.

In one embodiment, the globe for a light fixture comprises transparent plastic globe means for covering a light fixture that includes a light bulb. The globe means has a circumferentially extending wall and an opening for introduction of the light fixture at one end thereof. Prismatic light refracting means extend over at least a substantial portion of the wall and are integrally formed in the wall on both the inside and outside thereof.

Further features and advantages will become apparent from the following detailed description when taken in conjunction with the accompanying drawings.

DETAILED DESCRIPTION OF PREFERRED EMBODIMENTS

Figure 4:
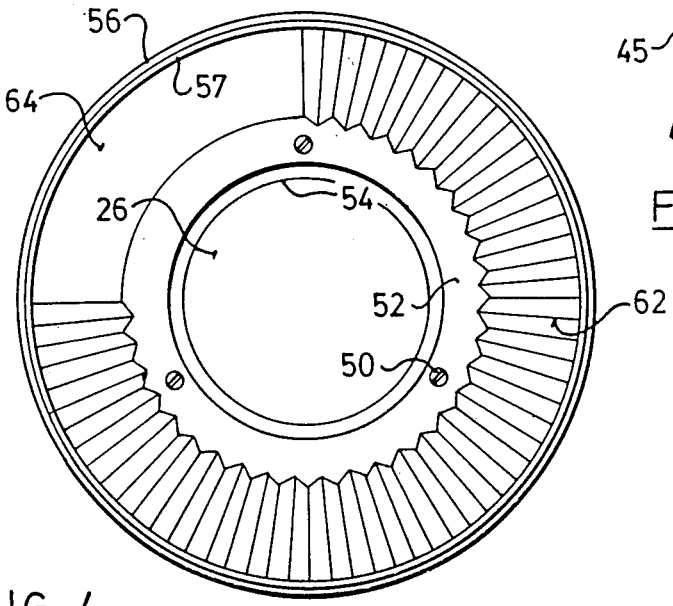
FIG. 4 is a sectional view taken along the line IV—IV of FIG. 1 showing the interior of the lower portion of the globe.

A globe 10 for a lighting fixture 12 can be shaped and fashioned in the manner of a so-called Washington style street light (also known as a type 118 street light). The light fixture is mounted on a post capital 14 which can be mounted on top of a hollow post (not shown). Set screws threaded into holes 16 are used to secure the capital 14. Arranged in the capital 14 is quick disconnect ballasting 18. Mounted at the top of the capital on ballast module plate 30 is a porcelain mogul socket 22 that accommodates a suitable light bulb 24. The light fixture per se and the support therefor can be of known construction provided they are arranged to permit the introduction of at least part of the light fixture, including the light bulb into the opening 26 formed in the bottom of the globe (see FIG. 4). Mounted by means of a threaded sleeve 27 arranged at the top of the globe 10 is a final 28, preferably made from cast aluminum.

Figure 2:
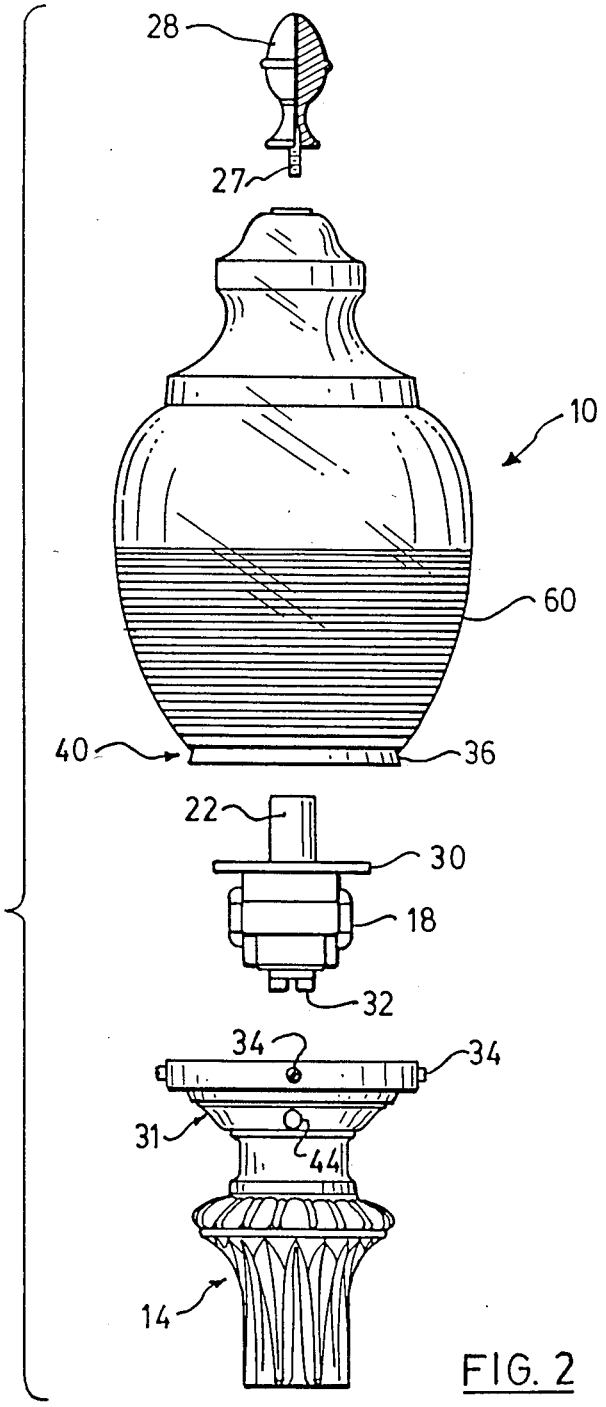
FIG. 2 is an exploded side view of the lamp fixture and globe of FIG. 1.
Figure 3:
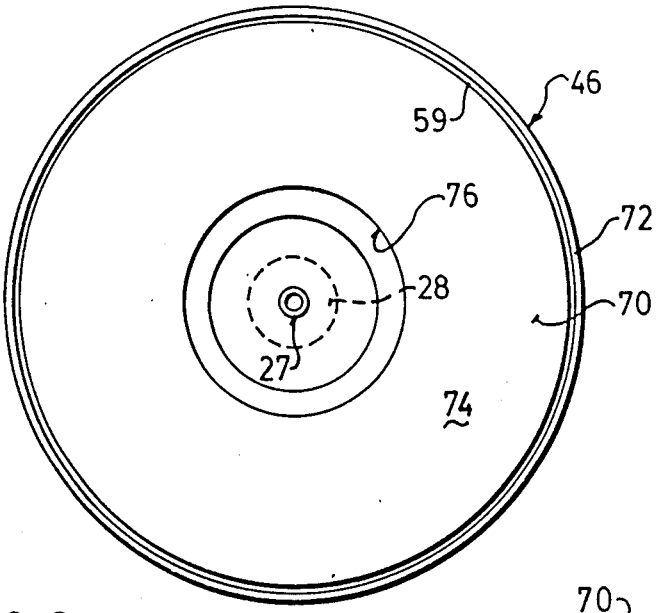
FIG. 3 is a sectional view taken along the lines III—III of FIG. 1 showing the bottom of the upper section of the globe including the reflector.

Turning now to the parts drawing of FIG. 2, it can be seen that the socket 22 is mounted on the ballast module plate 30, to the bottom of which is mounted the ballasting 18. A three lug terminal block 32 provides an electrical connection for the wiring that extends through the capital. The base of the globe 10 can be attached to ballast housing 31 by means of four slotted screws 34 that extend through holes in the top of the housing. The base of the globe 10 is preferably provided with an aluminum attachment ring 36 that sits in an annular recess 38 formed at the top of the ballast housing. As shown in FIG. 2, the ring 36 forms a V-shaped channel 40 about its circumference. The aforementioned screws 34 are screwed through their respective threaded holes 42 until they extend into the channel 40, thereby holding the globe firmly in place.

If desired, the capital 14 can be provided with a standard photoelectric control indicated at 44.

Figure 5:
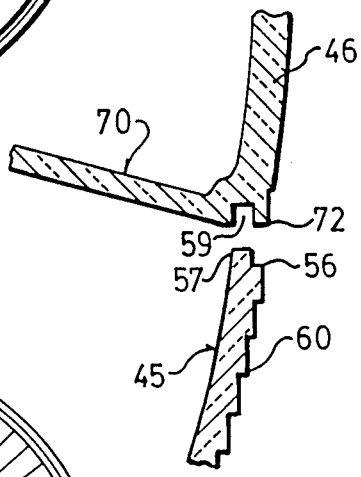
FIG. 5 is a detail view showing the shape of the connecting edges where the lower and upper portions of the globe are joined.

Turning now to the construction of the globe itself, according to one preferred embodiment of the globe, it is constructed from ultraviolet light stabilized polycarbonate. Although it is possible to construct the globe 10 in one piece, the illustrated globe is formed from lower or first portion 45 and an upper or second portion 46 that are permanently adhered together. The construction of the lower portion 45 which has integral prismatic light refracting means extending over the inner and outer surfaces thereof will now be described, with particular reference to FIGS. 1 and 4. The lower portion 45 can be made by the known technique of injection molding in order to provide the desired refracting means on both surfaces. The aforementioned ring 36 is attached to the lower portion 45 by means of slotted screws 50 and a suitable adhesive. The screws 50 extend through holes in a radially extending flange 52 formed at one end of the globe. The adhesive is applied between the lower surface of the flange 52 and the top surface of the ring 36. In the configuration shown in FIG. 4, which is a variation from that shown in FIG. 1, the interior of the ring 36 is formed with an upwardly extending rim 54. The rim 54 provides a means for quickly centering the flange 52 on the ring. The upper edge 56 can, if desired, be provided with an circumferentially extending tongue 57 that fits into a cooperating groove 59 formed about the perimeter of the upper portion 46 (see FIG. 5).

The exterior surface of the lower portion 45 is covered with integral prismatic light refracting means, generally in the form of either horizontally extending or vertically extending grooves 60. Horizontally extending grooves can be seen on the lower portion in FIG. 1. However, unlike the prior art, the lower portion 45 is also provided with prismatic light refracting means extending over at least a substantial portion of the inner surface as well. In the embodiment illustrated in FIG. 4, the inner refracting means take the form of vertically extending grooves 62. In the illustrated embodiment, the inner grooves 62 do not extend over the entire inner surface. Rather, there is a region indicated at 64 which can be substantially smooth or only slightly grooved. The purpose of the region 64 is to provide means for reducing the amount of light emitted from one side of the globe. In normal use of the globe, the region 64 is directed to an area or location where a considerable amount of light is not desired or is not required, for example the house side of a street light. In one embodiment of the globe, the exterior surface of the lower portion in the region 64 only is provided with vertical grooves only and no horizontal grooves. In this embodiment, the region 64 extends through a horizontal arc of about 90 degrees as shown. This arrangement results in a reduction in the amount of light passing through the region 64. It should be further understood that the prismatic light refracting means are constructed in a manner known per se in the lighting art. Accordingly, a detailed description of the arrangement of the prisms is deemed unnecessary for purposes of the present application. It should also be appreciated that in a preferred embodiment, the construction of the refracting means is designed by a computer in order to obtain the maximum light output according to a preferred desired pattern. In particular, for street and road lighting purposes, the globe 10 can be constructed with refracting means so that it is either an I.E.S. type II or a type V.

It should also be understood that the advantage of having prismatic refracting means on both the inside and outside surfaces is that the distribution of light can be controlled in both the vertical direction and in the horizontal direction. If the prismatic refracting means are provided only on the outside surface (in accordance with the prior art), the light distribution can only be controlled in the vertical direction. The provision of vertically extending grooves on the inside surface permits control of the light distribution in the horizontal direction as well.

Turning now to the construction of the upper portion 46, this portion can be made by either rotational molding, sometimes referred to as spin molding, or preferably by blow molding. The interior surface 66 is generally smooth while the exterior surface 68 can either be smooth or rippled depending on the desired effect. The upper portion 46 is preferably permanently attached to the lower portion 45 by means of a silicone sealant. The connecting edges of the upper and lower portions, which are formed as a tongue and groove, are preferably prepared by etching them with a petrol distillate such as that sold under the trade name Xylol. The silicone sealant is then applied about the circumferential edge of one portion and then the two portions are connected together.

Figure 1:
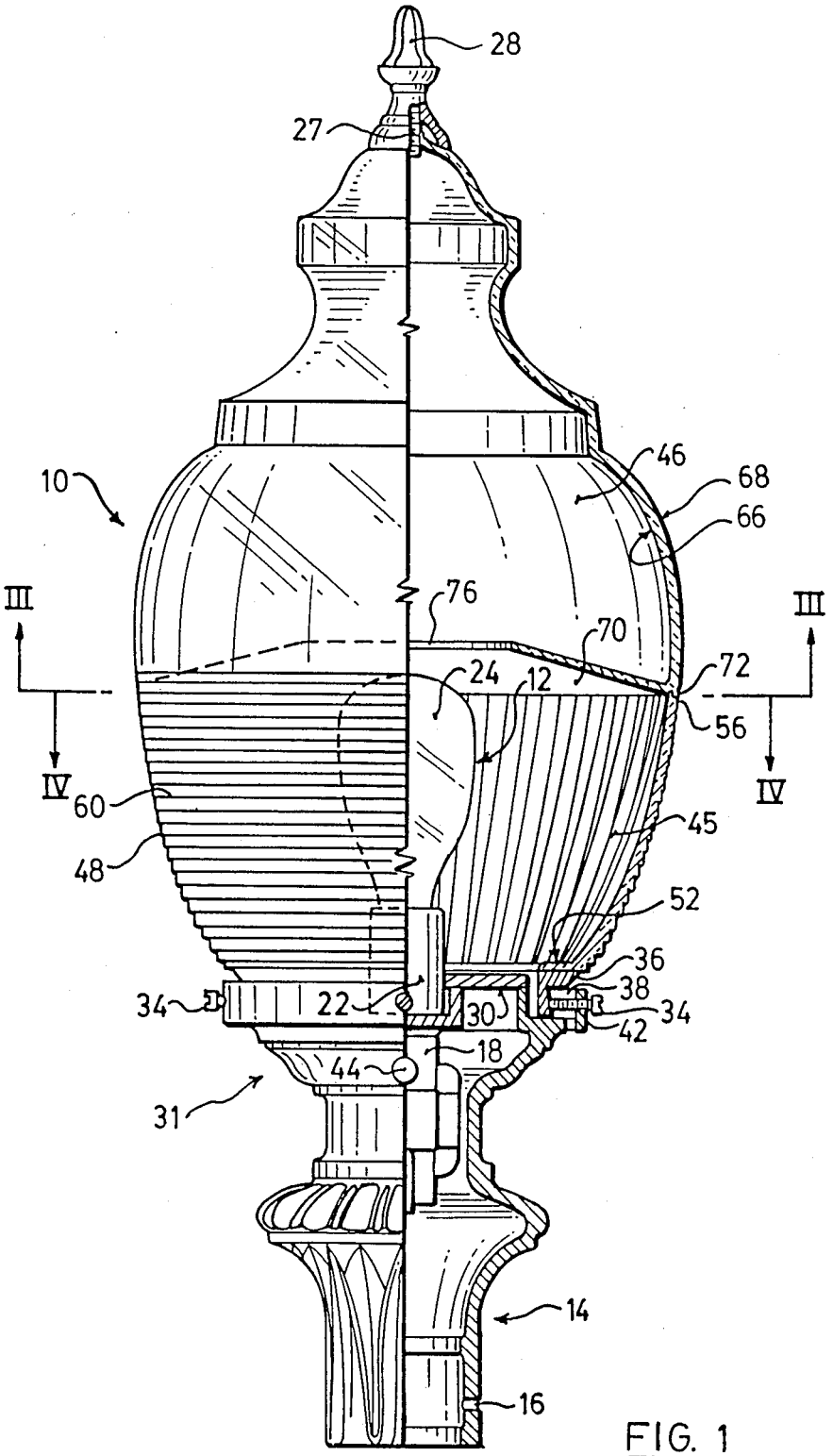
FIG. 1 is a side elevation, partly in section, illustrating a light fixture fitted with a globe constructed in accordance with the present invention.

Preferably, a reflector 70 is integrally formed in the interior of the globe as shown in FIG. 1. In the preferred embodiment shown, the reflector is integrally formed on the upper portion 46 and extends inwardly from a bottom edge 72 of the upper portion. The reflector which has a circular perimeter is preferably aluminized on its bottom surface 74. There is a circular opening 76 in the center of the reflector and this opening during use of the globe is positioned directly above the light bulb 24. Because of the position of the reflector 70 at the bottom end of the upper portion, it is located centrally in the globe 10. If more light is desired in the upper portion of the globe, the reflector 70 can be left clear and not painted with a reflecting paint. Instead of aluminum paint on the reflector, white paint could be used.

Figure 6:
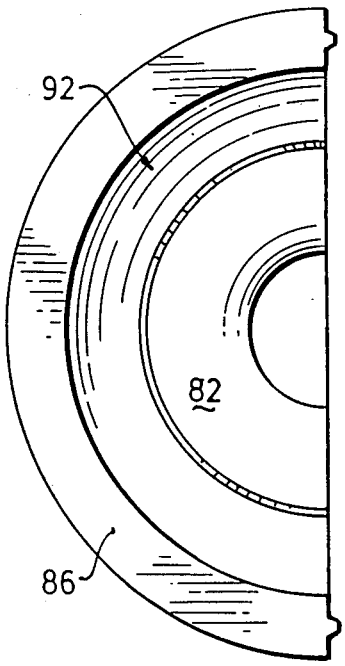
FIG. 6 is an end view of one of the mold sections used to construct the globe shown in FIGS. 1 and 2.
Figure 7:
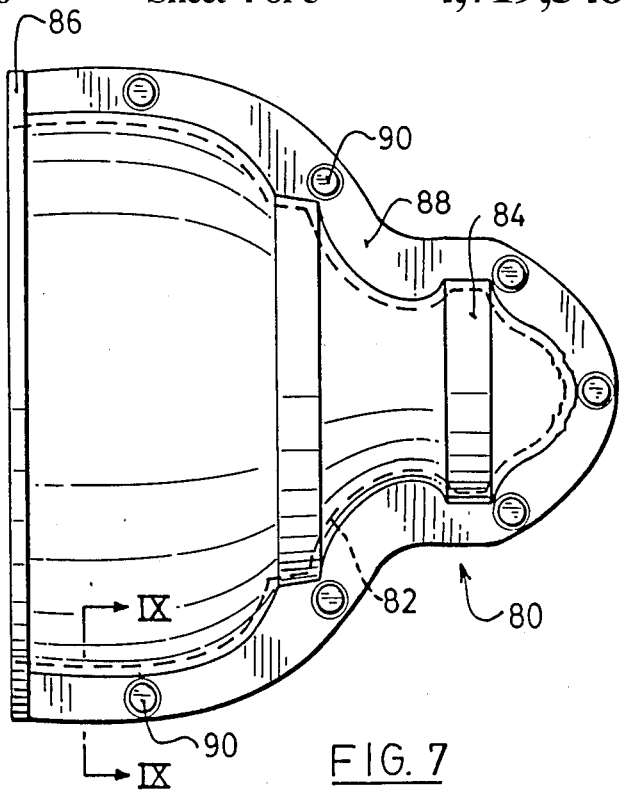
FIG. 7 is a plan view of the mold section.
Figure 9:
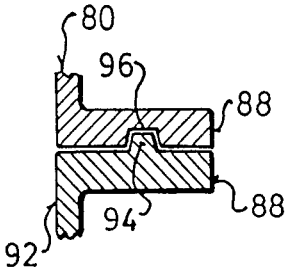
FIG. 9 is a sectional detail along the line IX—IX of FIG. 7 showing the tongue and groove connection used between the two mold sections shown in FIG. 8.

The construction and layout of the mold sections that can be used to make the upper portion 46 by rotational molding is shown in FIG. 6 to 12 of the drawings. A mold section 80 has a mold cavity 82 formed therein. The cavity 82 is shaped in a manner corresponding to the desired external shape of the upper portion 46 of the globe. In the embodiment shown, the mold section and its cavity are wide at the left hand end and much narrower at the right hand end where the top of the globe is formed. The thickness of the wall 84 can, for example, range between 0.1875 inch and ¼ inch. At the open or large end of the mold section 80 is a radially extending flange 86 which extends in a semi-circle as shown in FIG. 6. A peripheral flange 88 that forms a mating surface for the mold section extends about its perimeter, except at the open left hand end. Extending upwardly from this flange are seven mold mounting pins 90 that are used to connect the mold section to an angle iron frame used to rotate the complete mold.

Figure 8:
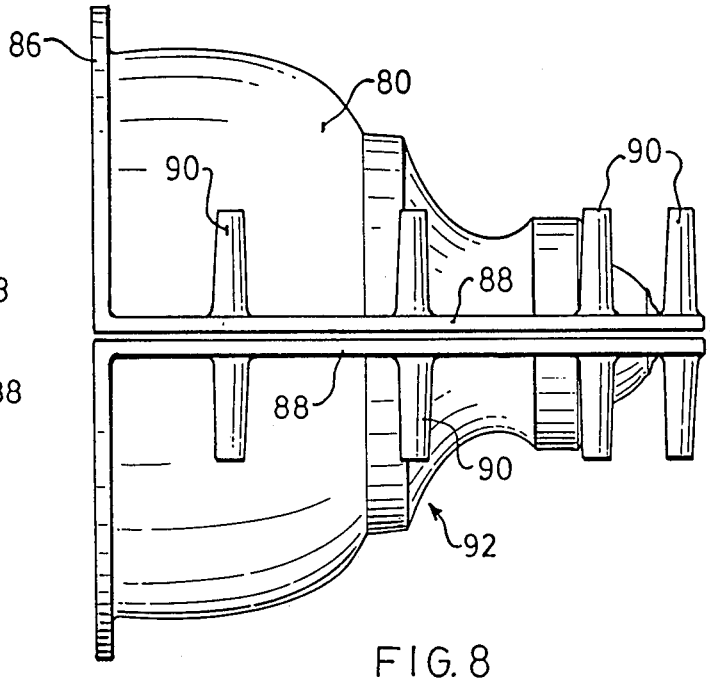
FIG. 8 is a side view showing two of the mold sections of FIGS. 6 and 7 positioned with their open sides adjacent one another.

In addition to the mold section 80, there is a mating and very similar mold section 92 shown in FIGS. 6 and 8. In fact, the only significant difference between the section 80 and the section 92 is that one of them is provided with a tongue 94 along its peripheral flange 88 while the other is provided with a mating groove 96 as shown in the FIG. 9 detail. In the illustrated embodiment, the tongue 94 is formed on the mating surface of the section 92 while the groove is formed on the mating surface of the section 80. This type of connection ensures that the two sections are properly mated together for the rotational molding process.

Figure 10:
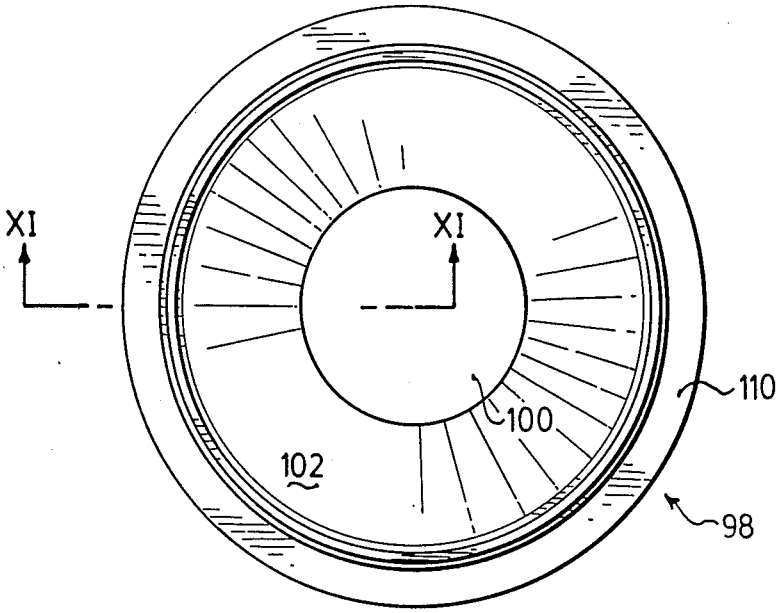
FIG. 10 is a plan view of a third mold section used in conjunction with the two mold sections shown in FIG. 8.
Figure 11:
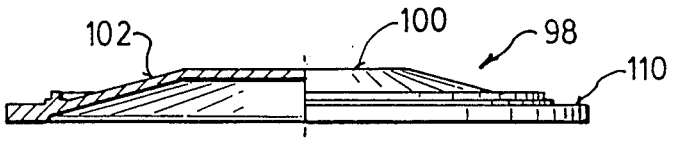
FIG. 11 is an edge view, partly in section along the line XI—XI of FIG. 10, of the third section of the mold; and, FIG. 12 is a sectional view of the third section of the mold similar to the left hand side of FIG. 11 but on a larger scale.
Figure 12:
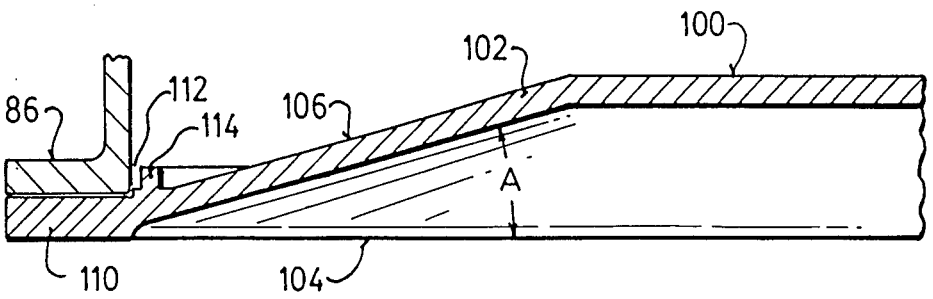

The third section for the mold is shown in FIGS. 10 to 12. It will be understood that this section 98 is fitted over the open end of the cavity formed by the mated sections 80 and 92. The section 98 is dish-shaped having a flat circular center 100 and an annular sloping section 102. In a preferred embodiment, the section 102 slopes at a 15 degree angle to the plane formed by the side 104 of the mold section 98. This angle is indicated at A in FIG. 12. It will be understood that the upper surface 106 forms the bottom surface of the reflector 70. Extending about the circumference of the section 98 is a flat connecting flange 110 that rests against the flange 86 of the two larger mold sections. Proper centering of the mold section 98 is ensured by providing a circumferentially extending shoulder 112, the outer diameter of which corresponds closely to the internal diameter of the mold sections 80 and 92 at the open end thereof. In order to provide the desired groove at the edge of the upper portion 46 of the globe, there is provided a circular ridge 114, the outer diameter of which is slightly less than the diameter of the shoulder formed at 112.

It will be understood that when the three mold sections 80, 92 and 98 have been properly fitted together, the required amount of plastic having been inserted into the cavity formed thereby, the completed mold is rotated in all directions and heated in an oven in a known manner. This causes the plastic in the cavity to melt and distribute itself evenly over the interior surface of the mold. The mold is then quickly cooled by being squelched with water.

If blow molding is used to create the upper portion of the globe, similar mold sections to those shown can be used. A preform is made by injection molding and this preform has the same density as the finished globe section. It is preheated in a batch oven to a suitable temperature and heated in such a manner that the heat is distributed evenly throughout the preform. The preform is then inserted into the mold which is mounted in such a manner that the top end of the finished globe section is a the bottom of the mold. The hole through which the preform is inserted is at the top of the mold. Pressurized air is then blown into the preform so that it expands to fill the mold cavity. 100 psi air is suitable for this purpose. The formed globe section can then be quickly removed from the mold so the mold can be used to make the next globe section. It will be understood that this process, which is a well known process in the glass making industry, is much quicker than the aforementioned rotational molding and therefore production costs can be reduced considerably by the use of this method.

The use of blow molding will also result in a better quality product generally.

Although reference has been made to the construction of the globe 10 by using two separate portions manufactured by different processes, which portions are then adhered together, it is possible to manufacture a similar globe in one piece. This can be done if two plastic compounds with different melt temperatures are used. It will be understood by one skilled in the art that one of these plastic compounds is then used to make the lower half of the globe while the other plastic compound is used to produce the upper half together with the internal reflector.

It will be clear to those skilled in the manufacture of glass and plastic globes for luminaires that various modifications and changes can be made to the globe without departing from the spirit and scope of this invention. For example, the upper portion of the globe can be made so that it is clear, clear translucent, or rippled by known manufacturing techniques. All such modifications and changes as fall within the scope of the appended claims are intended to be part of this invention.

I therefore claim:

1. A globe for a light fixture comprising transparent globe means capable of covering a light fixture and having an opening at one end for introduction of at least part of said light fixture, said globe means being formed from upper and lower portions that are adhered together and having integral prismatic light refracting means extending over at least a substantial portion of the inner and outer surfaces thereof, and a circular reflector integrally formed in the interior of said globe means and adapted to be positioned above a light bulb in said light fixture, said reflector having an opening in the center thereof which during use of said globe is positioned directly above said light bulb.

2. A globe for a light fixture according to claim 1 wherein said globe means is made of ultraviolet light stabilized polycarbonate.

3. A globe for a light fixture according to claim 1 wherein said prismatic light refracting means extends over a major portion of the inner and outer surfaces of said lower portion of said globe means.

4. A globe for a light fixture according to claim 1 wherein said reflector forms a partial cone having a sloping reflecting surface that forms an angle in a vertical plane extending through the center of said globe means of about 15 degrees to the horizontal.

5. A globe for a light fixture comprising transparent globe means capable of covering a light fixture and having an opening at one end for introduction of at least part of said light fixture, said globe means being formed from upper and lower portions that are adhered together and having integral prismatic light refracting means extending over a major portion of the inner and outer surfaces of said lower portion, and a reflector integrally formed in the interior of said globe means and adapted to be positioned above a light bulb in said light fixture, wherein said reflector is integrally formed on said upper portion and extends inwardly from a bottom edge of said upper portion.

6. A globe for a light fixture according to claim 5 wherein said reflector forms a partial cone having a sloping reflecting surface that forms an angle in a vertical plane extending through the center of said globe means of about 15 degrees to the horizontal.

7. A globe for a light fixture comprising transparent plastic globe means for covering a light fixture including a light bulb, said globe means having a circumferentially extending wall and an opening for introduction of said light fixture at one end thereof, said globe means being formed from first and second portions that have been joined together, prismatic light refracting means extending over at least a substantial portion of said wall on said first portion and integrally formed in said wall on both the inside and outside thereof, and reflecting means integrally formed at one end of said second portion where the latter is joined to said first portion.

8. A globe for a light fixture according to claim 7 wherein said reflecting means is in the interior of said globe means above the location of said light bulb during use of said globe.

9. A globe for a light fixture according to claim 8 wherein said refracting means extend circumferentially around said globe means through a complete 360 degree arc.

10. A globe for a light fixture according to claim 7 wherein both said first and second portions are made from ultraviolet light stabilized polycarbonate.

11. A globe for a light fixture according to claim 7 wherein said reflecting means is centrally located in said globe means and has an opening in the center thereof and wherein said reflecting means and said second portion are made from transparent polycarbonate, said reflecting means being coated with a reflecting paint on one side.

12. A globe for a light fixture according to claim 7 wherein said refracting means extends over a lower portion of said wall from the bottom end thereof to about midway up the height of said wall and extends horizontally through a complete 360 degree arc.

13. A globe for a light fixture according to claim 12 wherein said reflecting means is in the interior of said globe means at the top end of said reflecting means.

14. A globe for a light fixture according to claim 13 wherein said refracting means includes means for reducing the amount of light emitted from one side of said globe means.

15. A globe for a light fixture according to claim 7 wherein an aluminum attachment ring is connected to one end of said globe means and defines said opening, said ring being connected by means of screws and adhesive to a radially extending flange formed at said one end of said globe means.

16. A globe for a light fixture according to claim 7 wherein said reflector forms a partial cone having a sloping reflecting surface that forms an angle in a vertical plane extending through the center of said globe means of about 15 degrees to the horizontal.

17. A globe for a light fixture comprising transparent plastic globe means for covering a light fixture including a light bulb, said globe means having a circumferentially extending wall and an opening for introduction of said light fixture at one end thereof, said globe means being constructed from separate first and second portions that are connected together, prismatic light refracting means extending over at least a substantial portion of said wall and integrally formed in said wall on both the inside and outside thereof, said first portion having said refracting means formed thereon and being made by injection molding, said refracting means extending from the bottom end of said wall to about midway up the height of said wall and extending horizontally through a 360 degree arc, and reflecting means in the interior of said globe means at the top end of said refracting means, the second portion having said reflecting means formed thereon at an end of said second portion connected to said first portion.

18. A globe for a light fixture according to claim 17 wherein said second portion is made by blow molding.

19. A globe for a light fixture according to claim 17 wherein said second portion is made by rotational molding.

20. A globe for a light fixture comprising transparent globe means capable of covering a light fixture and having an opening at one end for introduction of at least part of said light fixture, said globe means including integral prismatic light refracting means extending over at least a substantial portion of the inner and outer surfaces of said globe means and a circular reflector integrally formed in the interior of said globe means, said reflector having an opening in the center thereof which, during use of said globe, is positioned directly above a light bulb in said light fixture.

21. A globe for a light fixture comprising transparent globe means capable of covering a light fixture and having an opening at one end for introduction of at least part of said light fixture, said globe means including integral prismatic light refracting means extending over at least a substantial portion of the inner and outer surfaces of said globe means, and a reflector located in the interior of said globe means and adapted to be positioned above a light bulb in said light fixture, wherein said globe means is formed from upper and lower portions that are connected together and said reflector is integrally formed on said upper portion and extends inwardly from a bottom edge of said upper portion.

* * * * *